United States Patent [19]

Iannone

[11] 4,394,857

[45] Jul. 26, 1983

[54] INSERT FOR A STOVE

[76] Inventor: Samuel J. Iannone, 15 W. Willow St., Beacon, N.Y. 12508

[21] Appl. No.: 268,005

[22] Filed: May 28, 1981

[51] Int. Cl.[3] ..... F24C 1/00

[52] U.S. Cl. ..... 126/60; 126/77; 126/146; 126/152 B; 126/176 A

[58] Field of Search ..... 126/60, 61, 163 R, 164, 126/165, 152 R, 155, 162, 169, 176 A, 144, 149, 146, 147, 151, 155, 77, 76

[56] References Cited

U.S. PATENT DOCUMENTS

| | | | |
|---|---|---|---|
| 418,810 | 1/1890 | Musick | 126/165 |
| 483,410 | 9/1892 | Watts | 126/165 |
| 741,192 | 10/1903 | Travis | 126/147 |
| 761,340 | 5/1904 | Tucker | 126/145 |
| 1,028,928 | 6/1912 | Broussard | 126/60 |
| 4,094,302 | 6/1978 | Rohr | 126/400 |
| 4,319,555 | 3/1982 | Melvin | 126/60 |

FOREIGN PATENT DOCUMENTS

| | | | |
|---|---|---|---|
| 861873 | 2/1941 | France | 126/60 |

*Primary Examiner*—James C. Yeung

*Attorney, Agent, or Firm*—Shoemaker and Mattare, Ltd.

[57] ABSTRACT

An insert for a stove permits efficient burning of either coal or wood and includes a movable grate. Granular material is located around the insert for modulating the heat transferred to the stove walls from a fire on the grate. Bumps project upwardly from the grate to facilitate jostling of coal to remove ash from that coal.

10 Claims, 10 Drawing Figures

INSERT FOR A STOVE

BACKGROUND OF THE INVENTION

The present invention relates to stoves, and, more particularly, to inserts for stoves.

Stoves are becoming widely used as sources of heat for homes, cabins, and the like. These stoves can take the form of fireplace inserts, freestanding models, or the like. These stoves burn wood or coal, or the like, as fuel and have many designs for inputing heat to a room or other such enclosure.

Double walls are often used in such stoves, and these walls are often subjected to severe thermal gradients. Accordingly, there is need of a means for modulating the thermal gradient to which the walls of a double wall stove are subjected.

As the price of wood increases, coal becomes an attractive alternative source of fuel for such stoves. However, wood and coal have different draft requirements. For example, wood needs more volume than coal. Therefore, there is need of a means for adapting a stove for use as either a wood burning or a coal burning stove.

Grates have been known for many years. However, the present inventor is not aware of any such element which is adaptable for coal or wood and which also modulates the heat transferred to a stove wall. Furthermore, none of the known devices have adequate means for removing ash from coal so that hard coal can be efficiently used. Soft coal creates a great deal of smoke and thus is not acceptable; however, most known stoves only burn soft coal in an efficient manner.

SUMMARY OF THE INVENTION

The device embodying the teachings of the present invention is adaptable for efficient use with hard coal or wood and modulates the heat transferred to the stove wall.

The device includes an insert member having a grate and jogging means for jostling coal to facilitate removal of ash from that coal. The jogging means includes projections, or bumps, on the bars of the grate to promote rolling movement of coal supported on these bars. A removable means is used to move the grate to establish the jogging movement of the grate. The shaker grate permits burning of hard coal.

The insert further includes a removable baffle plate which, when in place, directs air flow in a direction proper for efficient burning of coal. Without the baffle plate, air flow is suitable for efficient burning of wood.

The insert member is used with double wall stoves, and is spaced from the inner wall of such stoves to define a gap. A heat transfer controlling mixture is located within the gap to modulate the heat transfer from the insert member to the stove wall. This mixture is granular and includes at least two materials. One of the materials has a high thermal conductivity and the other has a low thermal conductivity. The proper mix of these two materials permits a proper rate of heat transfer to the walls of the stove to occur. An example of the high thermal conductivity material is a metal oxide, and an example of the low thermal conductivity material is a silicate. Other materials can also be used and in many proportions, and these examples are not intended to be limiting.

OBJECTS OF THE INVENTION

It is a main object of the present invention to provide an insert member for a stove which permits efficient burning of either coal or wood.

It is another object of the present invention to establish a heat transfer rate to the walls of the stove from the combustion chamber of that stove which is proper for stove safety and which is maximized for the particular stove and fuel.

It is a further object of the present invention to provide an insert member for a stove which permits efficient removal of ash from coal.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
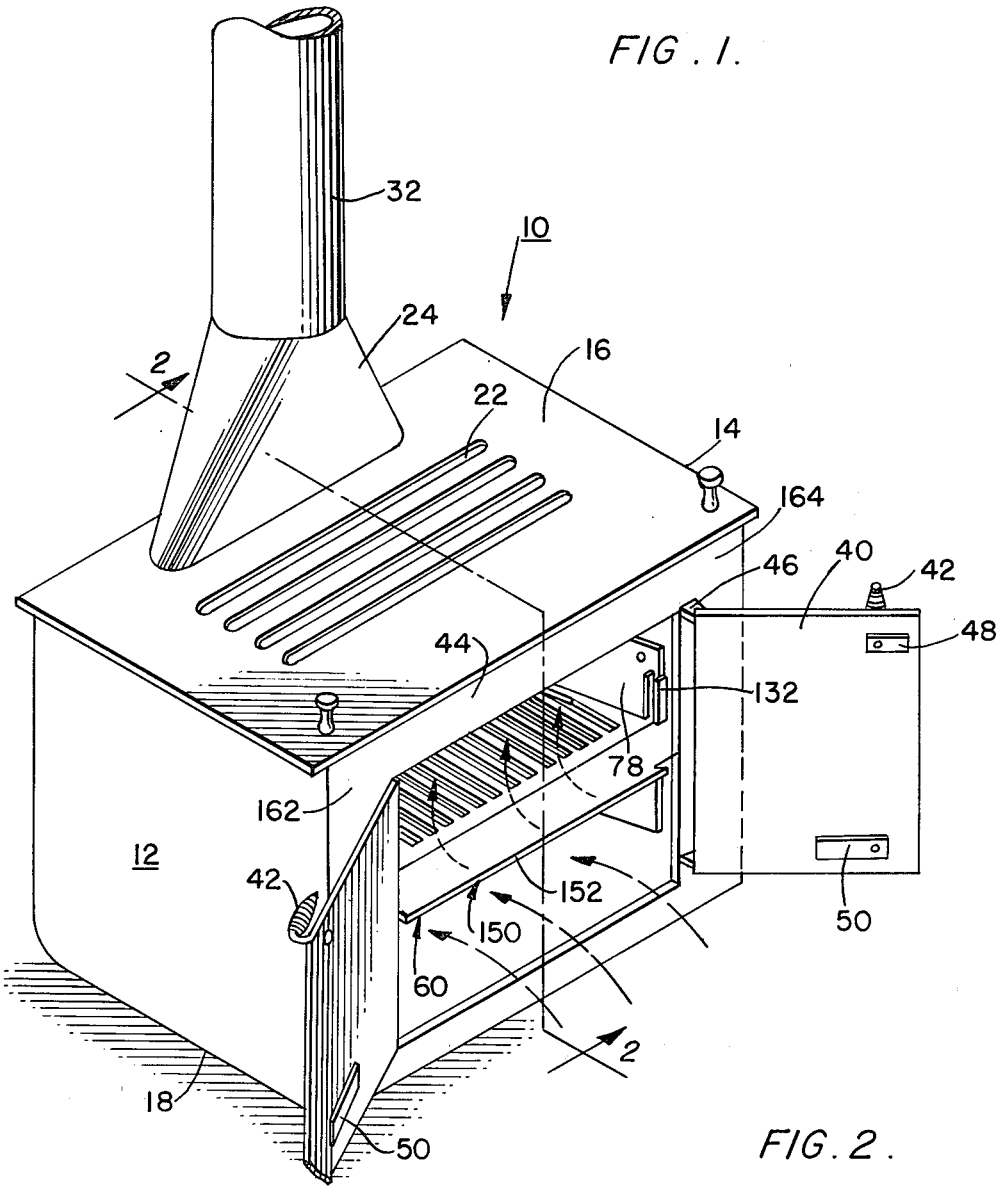
FIG. 1 is a perspective of a double wall stove having therein an insert member embodying the teachings of the present invention.

Shown in FIG. 1 is a stove 10 in which coal or wood is burned to provide heat, or the like. The stove 10 includes sides 12 and 14, a top 16 and a bottom 18 resting on a support 20. Air slots 22 are defined in the top and a connector 24 connects combustion chamber 30 to a flue pipe 32 to remove products of combustion from fuel F located within the combustion chamber. Doors 40 have handles 42 and are mounted on stove front 44 by hinges 46, or the like. A latch plate 48 is used to lock the doors closed. The doors can each have a latch plate, or can be overlapping, as suitable.

Figure 2:
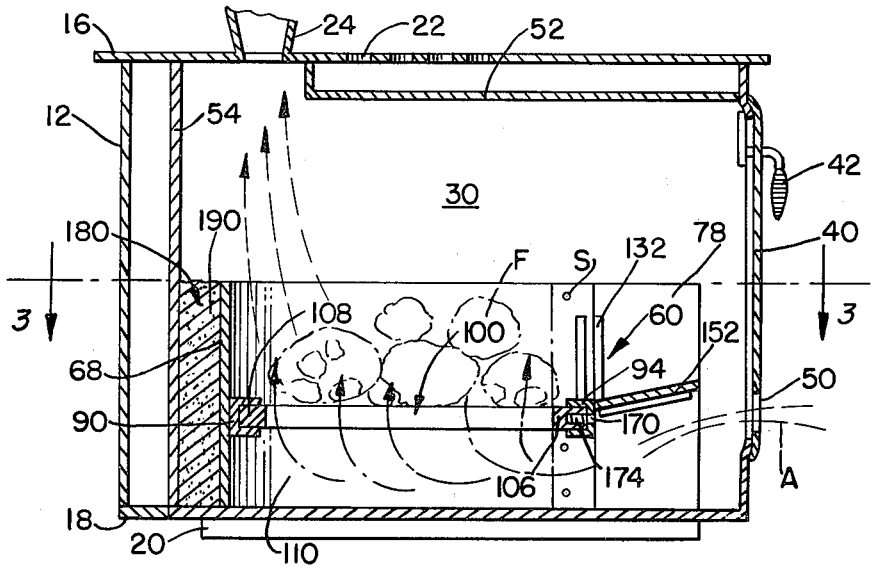
FIG. 2 is an elevation view taken along line 2—2 of FIG. 1.

Spiracles 50 are defined in each door to permit ambient air to enter the combustion chamber. The air flow is indicated in FIG. 2 by the arrows A. A baffle plate 52 is located subjacent the slots 22 in the top 16 to control the direction of air flowing into the combustion chamber via those slots. An inner rear wall 54 is spaced from the rear outer wall of the stove, and inner side walls 56 and 58 are spaced from the stove outer side walls 12 and 14 so that stove 10 is a double wall stove. It is noted that the insert member disclosed herein can be used with a single wall stove as well.

Figure 4:
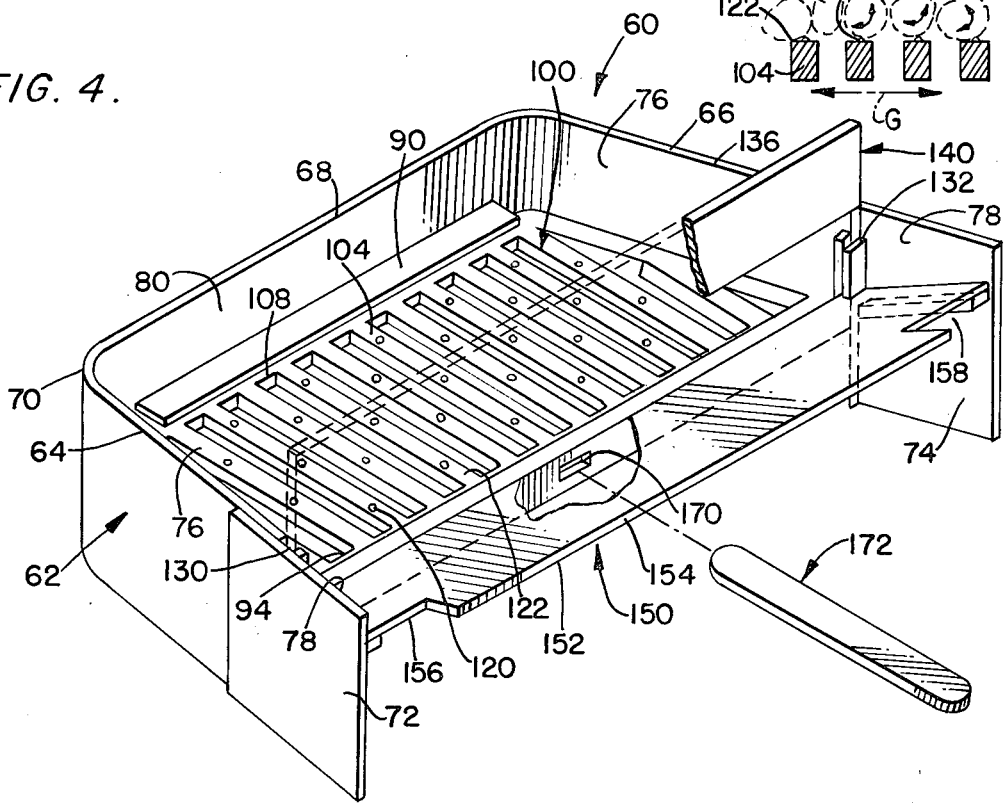
FIG. 4 is a perspective of an insert member embodying the teachings of the present invention.

An insert member 60 is used to support the combustible material in the combustion chamber 30, and is best shown in FIG. 4. The insert member includes a U-shaped base 62 having converging sides 64 and 66 and rear 68 connected to the sides by arcuate corners 70. Side plates 72 and 74 are attached to the sides 64 and 66, respectively, by fasteners S. The sides have inner faces 76, and the side plates have inner faces 78, and the rear has an inner face 80. It is noted that the shape of the insert member shown in the figures is an example and is not intended as a limitation.

A U-shaped channel bracket 90 is mounted on the rear inner face 80 to open outwardly and to be horizontally disposed. A U-shaped front channel bracket 94 is mounted on inner faces 76 of the sides as shown in FIG. 2 to open rearwardly and to be horizontally disposed and co-level with the rear channel bracket 90.

Figure 5:
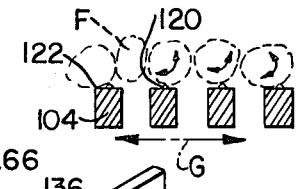
FIG. 5 is an end elevation view showing coal on a grate embodying a jogging means of the present invention.

A grate 100 is supported in the channel brackets 90 and 94 and is shaped to be loosely received in the base 62 and supported by those channel brackets. The grate includes a plurality of parallel bars 104 which extend from rear to front of the base 62, and front and rear head bars 106 and 108, respectively. The bars are all integrally connected to form a unitary grate. As shown in FIGS. 2 and 5, the bars are spaced apart a distance selected to support coal on the grate, but to permit ash from burning coal to fall through the grate into an ashpit 110 located beneath that grate.

A multiplicity of bumps or projections 120 project upwardly from upper surface 122 of each bar 104 for the purpose of rolling the pieces of coal to shake ash off those coal pieces, as will be discussed below. Such jogging and jostling of the coal permits the burning of hard coal.

As best shown in FIG. 4, a pair of vertically oriented facing channels 130 and 132 are mounted on the sides and side plates. The channels extend from superjacent the head bar 106 to a location spaced beneath top rim 136 of the insert member. An occluding baffle plate 140 is received and vertically mounted in the channels 130 and 132. The occluding baffle plate is shown in FIG. 4 to be partially in phantom line to indicate the removable nature thereof when the insert member is to be used for wood burning. The plate is used to prevent air from entering the combustion chamber via the door from above the coals when coal is used as a fuel for stove 10.

Figure 3:
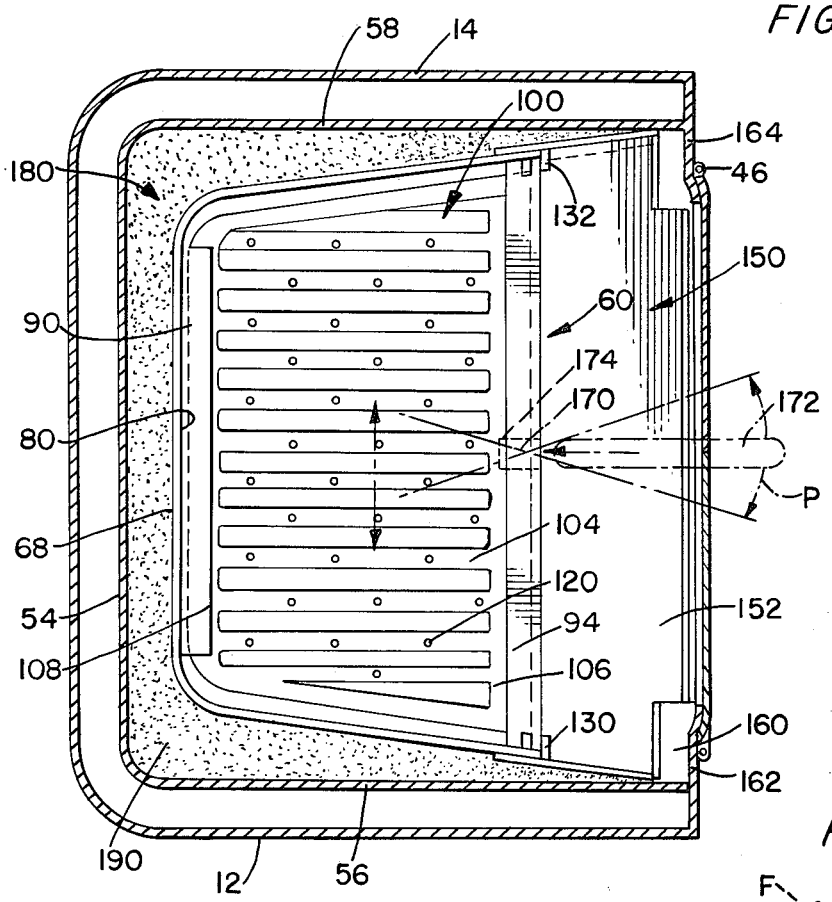
FIG. 3 is a plan view taken along line 3—3 of FIG. 2.

A front apron 150 includes a plate 152 attached at one side end thereof to the front channel bracket 94 and extending upwardly therefrom. Another side edge 154 of the plate has a pair of notches 156 and 158 defined therein so that gaps 160 are defined behind front portions 162 and 164 of the stove body, as shown in FIG. 3. Some of the air flowing into the combustion chamber via the door is deflected beneath the grate by the apron 150, as indicated in FIG. 2.

An elongate slot 170 is defined in front channel bracket 94 and a push rod 172 is received therethrough. An elongate blind-ended slot 174 is defined in the grate front head bar 106 and is aligned with the slot 170 to receive the push rod. Sideways movement of the push rod is shown in FIG. 3 by arrow P, and such sideways movement moves the grate as shown by arrow G in FIG. 5. This sideways movement of the grate combines with the bumps 120 to roll the coal as shown in FIG. 5 to remove ash from that coal as above-discussed. The slot 170 acts as a fulcrum for the push rod so that extremely vigorous shaking action of the coal can be established. The rod can be removed when not in use, so that rod does not interfere with operation of the stove. This shaking action can be executed with the occluding plate in place or not in place, as suitable. Thus, wood can be jostled, as well as coal.

As best shown in FIGS. 2 and 3, the insert member 60 is spaced from the inner walls of the stove to define a gap 180 between that insert member and the stove inner wall.

A granular material 190 is located in the gap 180 and fills that gap to the top, as shown in the figures. The material 190 is a conglomerate material which includes a first material having a high thermal conductivity and a second material having a low thermal conductivity. The materials are mixed in a proportion suitable to insulate the inner walls of the stove sufficiently to prevent warping, but which will transfer heat in sufficient quantities and rates to establish efficient heating by the stove 10.

Granular copper oxide is preferred for the first material, and silicate, such as sea sand, or the like, is the preferred second material. Aluminum oxide is also suitable for the first material. Other materials having suitable coefficients of thermal conductivity can also be used without departing from the scope of the present invention.

A mixture having 10% copper oxide is suitable for a gap size of ½ inch for gap 180; whereas, a mixture containing 50% copper oxide is suitable for a one inch spacing of gap 180; however, the proportions of the mixture can be any suitable value without departing from the scope of the present disclosure.

The mixture 190 permits use of this stove with hot fuels because of the control exercised over the amount and rate of heat transferred to the walls from the combustion chamber via the material 190. Extremely efficient stove operation can thus be established using either coal or wood as a fuel.

Figure 6:
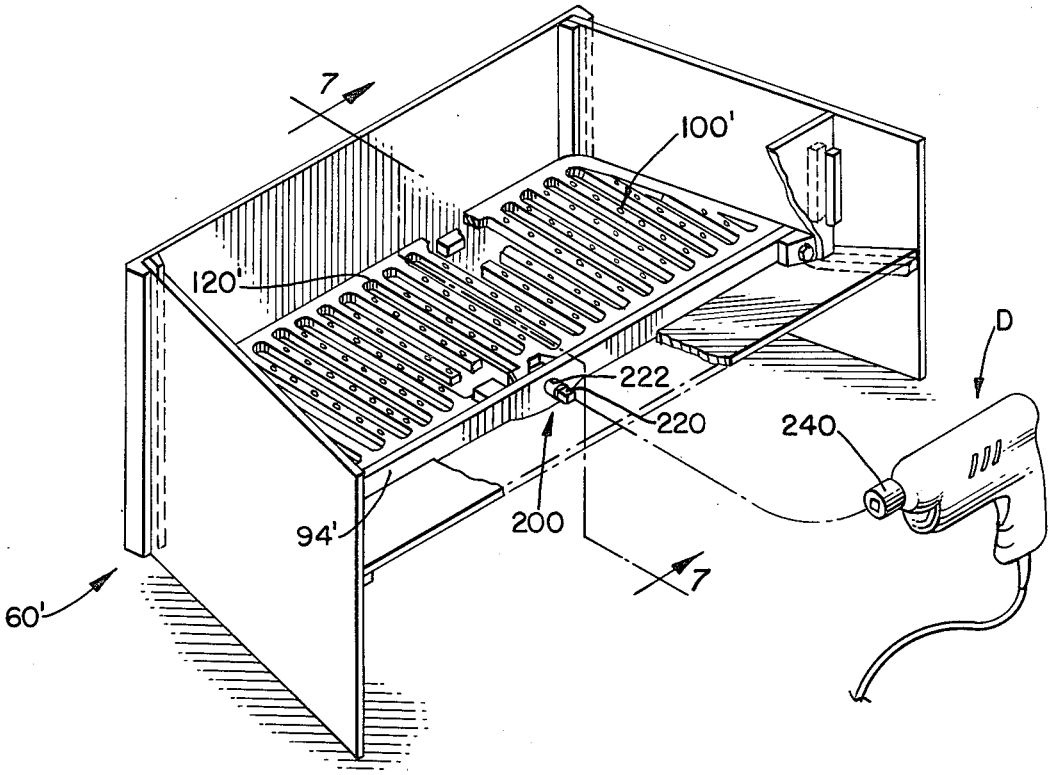
FIG. 6 is a perspective of an alternative form of an insert member embodying the teachings of the present invention.

An insert member 60' is an alternative form of the insert member 60 and is best shown in FIG. 6. Grate 100' can include projections 120' and is supported on the insert 60' in a manner similar to the manner grate 100 is supported on member 60. However, it is noted that the projections need not be included, if desired.

Figure 10:
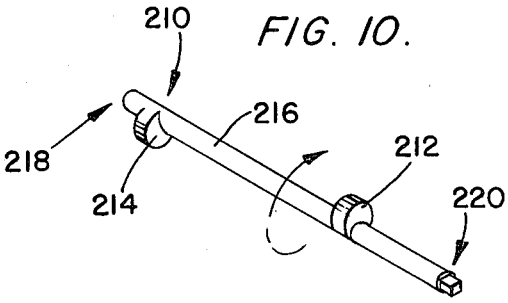
FIG. 10 is a perspective of a cam shaft used in conjunction with the FIG. 6 embodiment.

A jogging mechanism 200 is associated with the insert member 60', and includes a cam shaft 210 having a plurality of cams 212 and 214 eccentrically mounted on elongate shaft 216 in an alternating manner as best shown in FIG. 10. The shaft 216 includes a fore end 218 and an aft end 220 which is polygonal in shape. As best shown in FIG. 10, the cams 212 and 214 extend radially outward of the shaft 216 in diametrically opposed relationship with each other on that shaft. The cam 212 is located adjacent the aft end of the shaft 216 and the cam 214 is located adjacent the fore end of the shaft 216 for a purpose to be described below.

The cam shaft 210 is received in an opening 222 defined in the front channel bracket 94' which has a guide member 224 mounted on rear surface 226 thereof for supporting the grate. A further support 228 is mounted on inner surface 80' on the rear 68' of the insert member to further support the grate. Further support members can be included for securely support the grate on the insert member. A receiving hole 230 is defined in the rear 68' through which fore end 218 of the cam shaft is received.

The jogging means includes a cam shaft turning means, such as hand-held grill D having a chuck 240 which accommodates polygonal aft end 220 of the cam shaft. The aft end 220 is shaped and sized to be accommodated in a standard chuck of such a drill.

Figure 7:
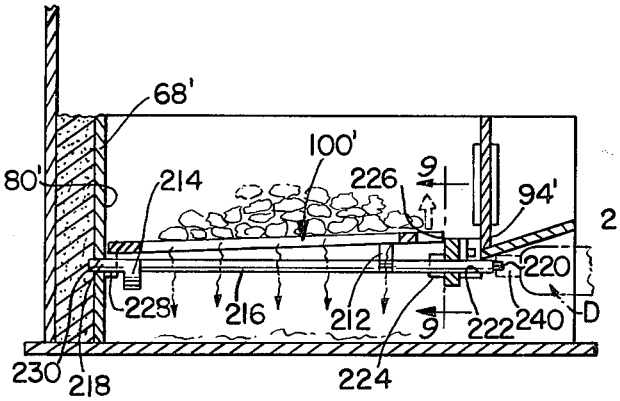
FIG. 7 is a view taken along line 7—7 of FIG. 6.
Figure 8:
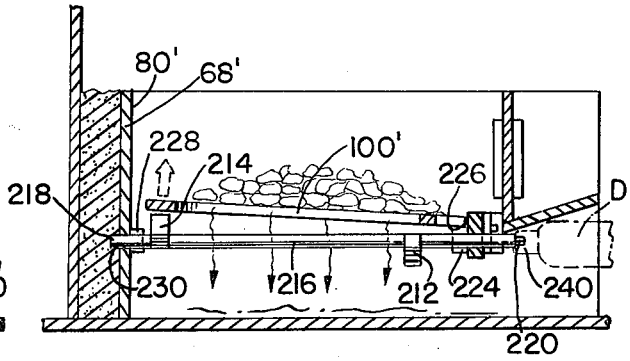
FIG. 8 is a view similar to FIG. 7 showing grate movement.
Figure 9:
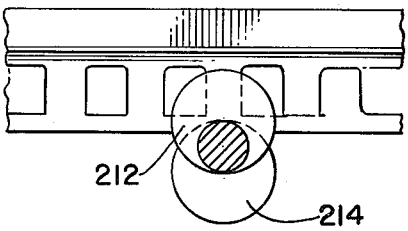
FIG. 9 is a view taken along line 9—9 of FIG. 7.

Rotation of the cam shaft by the drill jogs the grate as the cams contact that grate. As shown in FIGS. 7 and 8, the offset mounting of the cams causes the grate to be rearwardly declining in FIG. 7 and forwardly inclining in FIG. 8 as the cam shaft rotates. Preferably, the cams are mounted in diametrically opposed positions to achieve this alternating declination of the grate which assists in removal of ash from that grate; however, other cam mounting positions can be used. The opposed mounting of the cams is also shown in FIG. 9.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A stove comprising:

an outer rear wall, an outer front wall and outer side walls connected to said outer rear and front walls;

a plurality of inner walls located within said outer walls and including an inner rear wall and inner side walls connected to said inner rear wall, said inner walls being spaced from said outer rear walls, said spacing between said outer and inner walls defining a first gap;

a base including a base rear wall and base side walls connected to said base rear wall, said base rear wall being spaced from said inner rear wall and said base side walls being spaced from said inner side walls to define a second gap;

a grate and grate support means on said base walls for removably mounting said grate on said base walls, said grate including bars having bumps projecting upwardly therefrom;

grate moving means for moving said grate;

first air flow directing plate means on said base for deflecting air into an area located beneath said grate;

means for removably mounting a second air flow directing means on said base for directing air flow to a coal fire on said grate; and granular heat transfer means located in said second gap for modulating heat transferred from said insert member to said stove outer walls, said heat transfer means including a mixture of a first material having a high thermal conductivity and a second material having a low thermal conductivity.

2. The insert member defined in claim 1 wherein said first material includes a metal oxide.

3. The insert member defined in claim 2 wherein said second material includes a silicate.

4. The insert member defined in claim 2 wherein said metal oxide includes copper oxide.

5. The insert member defined in claim 2 wherein said metal oxide includes aluminum oxide.

6. The insert member defined in claim 1 wherein said grate moving means includes a lever insertable into a slot defined in said grate.

7. The insert member defined in claim 1 wherein said second air flow directing means includes a baffle plate which is vertically oriented.

8. The insert member defined in claim 1 wherein said grate moving means includes a cam shaft insertable into a hole defined in said grate and means for rotating said cam shaft.

9. The insert member defined in claim 8 wherein said cam shaft includes a plurality of cams mounted on an elongate shaft, said cams being mounted in pairs which include one cam located near one end of said shaft and one cam located near another end of said shaft with said cams being mounted to extend radially outwardly of said shaft in diametrically opposite directions.

10. The insert member defined in claim 9 wherein said cam shaft rotating means includes a hand-held drill and said elongate shaft includes a polygonal end adapted to be accommodated by said drill.

* * * * *